US008905766B2

(12) United States Patent
Her et al.

(10) Patent No.: US 8,905,766 B2
(45) Date of Patent: Dec. 9, 2014

(54) GROUNDING SYSTEM FOR TERMINAL BLOCK

(71) Applicants: La Her, White Bear Lake, MN (US); Erick Gulbranson, Saint Francis, MN (US)

(72) Inventors: La Her, White Bear Lake, MN (US); Erick Gulbranson, Saint Francis, MN (US)

( * ) Notice: Subject to any disclaimer, the term of this patent is extended or adjusted under 35 U.S.C. 154(b) by 156 days.

(21) Appl. No.: 13/733,096

(22) Filed: Jan. 2, 2013

(65) Prior Publication Data

US 2014/0187065 A1 Jul. 3, 2014

(51) Int. Cl.
*H01R 13/648* (2006.01)
*H01R 13/514* (2006.01)

(52) U.S. Cl.
CPC ..... *H01R 13/514* (2013.01)
USPC ..... 439/95

(58) Field of Classification Search
CPC ..... H01R 13/65802; H01R 13/648; H01R 13/658; H01R 4/64; H01R 23/6873
USPC ..... 439/95, 92, 709, 715
See application file for complete search history.

(56) References Cited

U.S. PATENT DOCUMENTS 1,610,033 A * 12/1926 Becker ..... 191/29 R
2,768,232 A * 10/1956 Kwake ..... 174/51
2,848,703 A 8/1958 Foote et al.
2,957,955 A 10/1960 Sleeter
3,057,975 A 10/1962 Motten, Jr.
3,118,714 A * 1/1964 Ludwig ..... 439/107
3,296,576 A 1/1967 Motten, Jr.
3,374,979 A * 3/1968 Coldren et al. ..... 248/222.12
3,432,793 A * 3/1969 McHattie et al. ..... 439/97
3,492,625 A * 1/1970 Bromberg ..... 439/100
3,499,097 A 3/1970 Widstrand
4,257,662 A 3/1981 Motten, Jr.
4,417,373 A 11/1983 Keglewitsch
4,500,161 A 2/1985 Keglewitsch et al.
4,500,162 A 2/1985 Keglewitsch et al.
4,516,815 A 5/1985 Venable et al.
4,547,036 A 10/1985 Keglewitsch et al.
4,971,582 A 11/1990 Keglewitsch et al.
5,037,317 A * 8/1991 Schwenk et al. ..... 439/92
5,151,560 A * 9/1992 Kreinberg et al. ..... 174/94 R
5,164,545 A * 11/1992 Kreinberg et al. ..... 174/94 R
5,267,125 A * 11/1993 Liu ..... 361/816

(Continued)

FOREIGN PATENT DOCUMENTS

CA 1199206 A1 1/1986
CA 1201739 A1 3/1986

(Continued)

*Primary Examiner* — Amy Cohen Johnson
*Assistant Examiner* — Vladimir Imas
(74) *Attorney, Agent, or Firm* — Quarles & Brady LLP

(57) ABSTRACT

A grounding system for a terminal block for wiring to electrical equipment housed within an enclosure is disclosed. The enclosure has a chassis and the terminal block has a grounding socket with an opening for receiving a fastener. The grounding system can include a mounting bracket configured to be coupled to the chassis of the enclosure. The grounding system can further include a grounding tab coupled to the mounting bracket. The grounding tab can including a proximal portion and a distal portion. The distal portion of the grounding tab can be configured to at least partially extend into the grounding socket of the terminal block such that the fastener passes through the opening in the grounding socket, contacts the grounding tab, and grounds the electrical equipment wired to the terminal block.

25 Claims, 5 Drawing Sheets

(56) References Cited

U.S. PATENT DOCUMENTS

| | | | | |
|---|---|---|---|---|
| 5,340,334 | A | 8/1994 | Nguyen | |
| 5,562,499 | A | 10/1996 | Minich | |
| 5,580,280 | A | 12/1996 | Minich et al. | |
| 5,595,507 | A * | 1/1997 | Braun et al. | 439/716 |
| 5,610,368 | A | 3/1997 | Smith | |
| 5,701,665 | A | 12/1997 | Kling | |
| 6,776,628 | B2 * | 8/2004 | Foriska et al. | 439/92 |
| 6,822,845 | B2 | 11/2004 | Chereson | |
| 6,857,881 | B1 * | 2/2005 | Balfour | 439/92 |
| 7,090,526 | B2 | 8/2006 | Monte et al. | |
| 7,128,583 | B2 * | 10/2006 | Tsuo | 439/92 |
| 7,147,492 | B2 * | 12/2006 | Mueller et al. | 439/95 |
| 7,241,178 | B2 | 7/2007 | Schaffner | |
| 7,435,134 | B2 * | 10/2008 | Lenox | 439/567 |
| 7,591,656 | B1 * | 9/2009 | Gretz | 439/108 |
| 7,731,512 | B1 * | 6/2010 | Montena et al. | 439/108 |
| 7,942,679 | B1 * | 5/2011 | Gretz | 439/108 |
| 8,152,575 | B2 * | 4/2012 | Boling et al. | 439/815 |
| 8,277,263 | B1 * | 10/2012 | Smith | 439/779 |
| 8,366,499 | B2 * | 2/2013 | Shuey et al. | 439/883 |
| 2003/0228802 | A1 | 12/2003 | Palagi et al. | |
| 2004/0084199 | A1 | 5/2004 | Chereson | |
| 2005/0202718 | A1 | 9/2005 | Monte et al. | |
| 2006/0051999 | A1 | 3/2006 | Allemann et al. | |
| 2006/0211308 | A1 | 9/2006 | Schaffner | |

FOREIGN PATENT DOCUMENTS

| | | | |
|---|---|---|---|
| CA | 1205532 | A1 | 6/1986 |
| CA | 1324632 | A1 | 9/1989 |
| CH | 83761 | A | 1/1920 |
| DE | 20316051 | U1 | 12/2003 |
| EP | 0282797 | A2 | 9/1988 |
| FR | 2528247 | A1 | 12/1983 |
| TW | I253218 | B | 4/2006 |

* cited by examiner

GROUNDING SYSTEM FOR TERMINAL BLOCK

CROSS REFERENCE TO RELATED APPLICATIONS

None.

BACKGROUND

A variety of electrical equipment for applications are often housed within electrical enclosures having a chassis, or frame. The electrical equipment is often wired to terminal blocks, which can be grounded by electrical connection to the enclosure itself. A grounding system 10 of the prior art is shown in FIGS. 1 and 2. Electrical equipment (not shown) is wired to the terminal block 12 with a series of wires 13 and the terminal block 12 is fastened to the chassis 14 of the enclosure 16. Another series of wires 15 is wired to the terminal block 12 to complete the circuit for the electrical equipment. The terminal block 12 shown in FIG. 2 is for wiring for three-phase power. The electrical equipment is grounded by running a grounding wire 18 leading from one side of the grounding socket 20 of the terminal block 12 to the chassis 14 of the enclosure 16 with a wire clip 22 and fastener 24. Such a grounding system 10 has the drawbacks of requiring a grounding wire 18, wire clip 22, and fastener 24 to ground the equipment to the ground socket 20 of the terminal block 12. In prior art grounding systems 10, it is common to affix the terminal block 12 and associated grounding wire 18, wire clip 22, and fastener 24 to a rear portion 17 of the enclosure 16. However, such an installation of the grounding system 10 provides for difficult access in the enclosure 16 due to the location of the grounding system 10 being in the rear portion 17 of the enclosure 16 and the bulk of electrical equipment within the enclosure 16, resulting in awkward and inefficient installation and/or maintenance of the grounding system 10.

SUMMARY OF THE INVENTION

One embodiment of the invention provides for a grounding system for a terminal block. The terminal block can be for wiring to electrical equipment housed within an enclosure. The enclosure can have a chassis. The terminal block can have a grounding socket with an opening for receiving a fastener. The grounding system can include a mounting bracket configured to be coupled to the chassis of the enclosure. The grounding system can also include a grounding tab coupled to the mounting bracket. The grounding tab can include a proximal portion and a distal portion. The distal portion can be configured to at least partially extend into the grounding socket of the terminal block so that the fastener passes through the opening in the grounding socket, contacts the grounding tab, and grounds the electrical equipment wired to the terminal block.

Another embodiment of the invention provides for an enclosure grounding system for grounding an electrical component housed within an enclosure. Electrical equipment can be wired to a terminal block having a grounding socket with an opening for receiving a fastener. The enclosure grounding system can include an enclosure configured to house the electrical component. The enclosure can include a chassis. The enclosure grounding system can include a grounding system that can include a mounting bracket and a grounding tab. The mounting bracket can be coupled to the chassis of the enclosure. A grounding tab can be coupled to the mounting bracket. The grounding tab can include a proximal portion and a distal portion. The distal portion can be configured to at least partially extend into the grounding socket of the terminal block such that a fastener passes through the opening in the grounding socket, contacts the grounding tab, and grounds the electrical component wired to the terminal block.

Yet another embodiment of the invention can provide for a grounding system for a terminal block. The terminal block can be for wiring to electrical equipment housed within an enclosure. The enclosure can have a chassis. The terminal block can have a grounding socket with an opening for receiving a fastener. The grounding system can include a mounting bracket configured to be coupled to the chassis of the enclosure. The mounting bracket can include a first mounting flange, a first side panel, and a back panel. The grounding system can also include a support member having a proximal end and a distal end. The proximal end can be coupled to the first side panel. The grounding system can further include a grounding tab including a proximal portion and a distal portion. The proximal portion can be coupled to the distal end of the support member. The distal portion of the grounding tab can be configured to at least partially extend into the grounding socket of the terminal block so that the fastener passes through the opening in the grounding socket, contacts the grounding tab, and grounds the electrical equipment wired to the terminal block. The support member can support the terminal block when the distal portion of the grounding tab at least partially extends into the grounding socket.

A further embodiment of the invention provides for an enclosure grounding system for grounding an electrical component housed within an enclosure. Electrical equipment can be wired to a terminal block having a grounding socket with an opening for receiving a fastener. The enclosure grounding system can include an enclosure configured to house the electrical component. The enclosure can include a chassis and a receiving portion. The receiving portion can receive the terminal block and can be integral to the enclosure. The enclosure grounding system can also include a grounding system that can include a support member and a grounding tab. The support member can have a proximal end and a distal end. The proximal end can be coupled to the enclosure. The grounding tab can include a proximal portion and a distal portion. The proximal portion can be coupled to the distal end of the support member. The distal portion of the grounding tab can be configured to at least partially extend into the grounding socket of the terminal block so that the fastener passes through the opening in the grounding socket, contacts the grounding tab, and grounds the electrical equipment wired to the terminal block. The support member can support the terminal block when the distal portion of the grounding tab at least partially extends into the grounding socket.

These and other features, aspects, and advantages of the present invention will become better understood upon consideration of the following detailed description, drawings, and appended claims.

DETAILED DESCRIPTION

Figure 1:
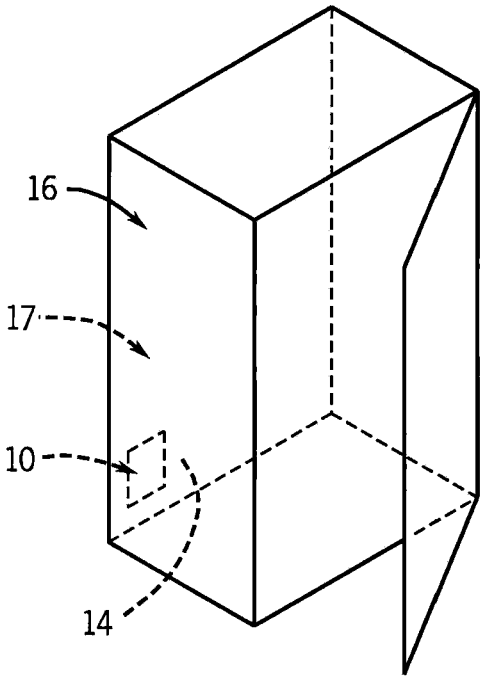
FIG. 1 PRIOR ART
FIG. 1 is a top, front, perspective view of a grounding system common of the prior art being installed in a rear portion of an enclosure.
Figure 2:
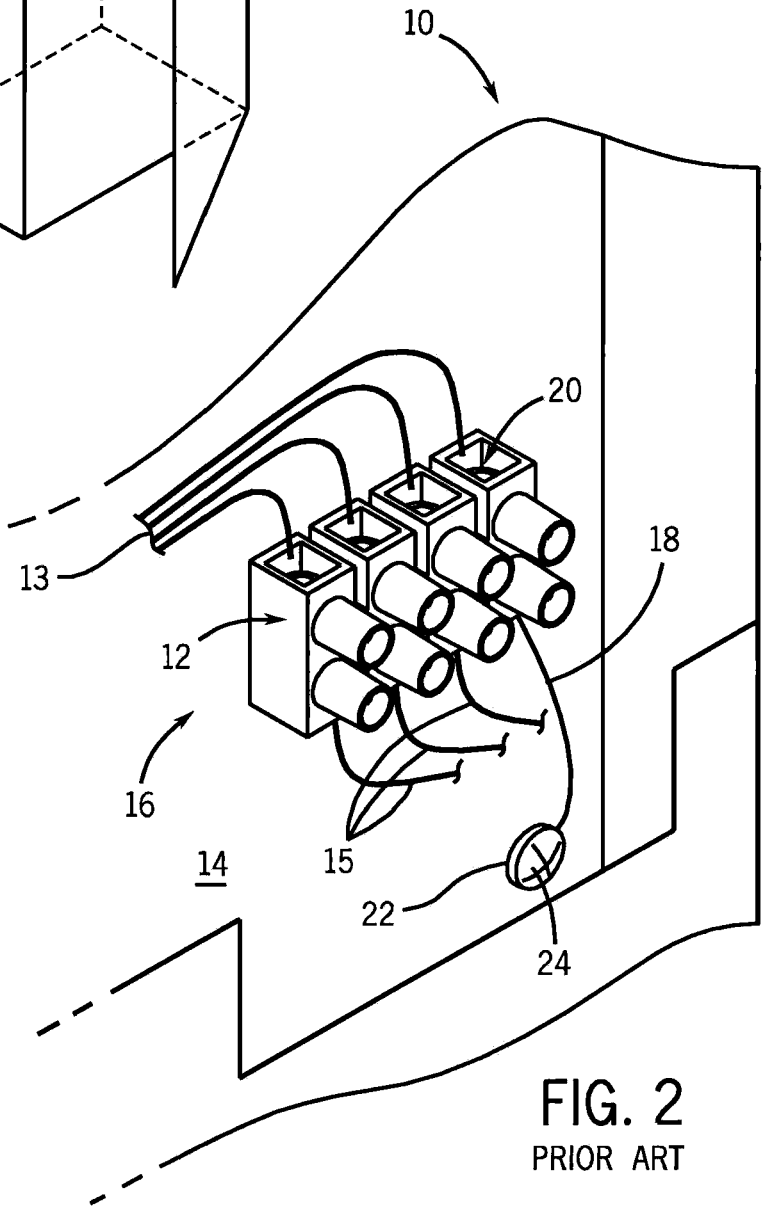
FIG. 2 PRIOR ART
FIG. 2 is a detailed, perspective view of a grounding system of FIG. 1 depicting a terminal block grounding a piece of electrical equipment to a chassis of an enclosure using a grounding wire and wire clip fastened to the chassis.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Figure 3:
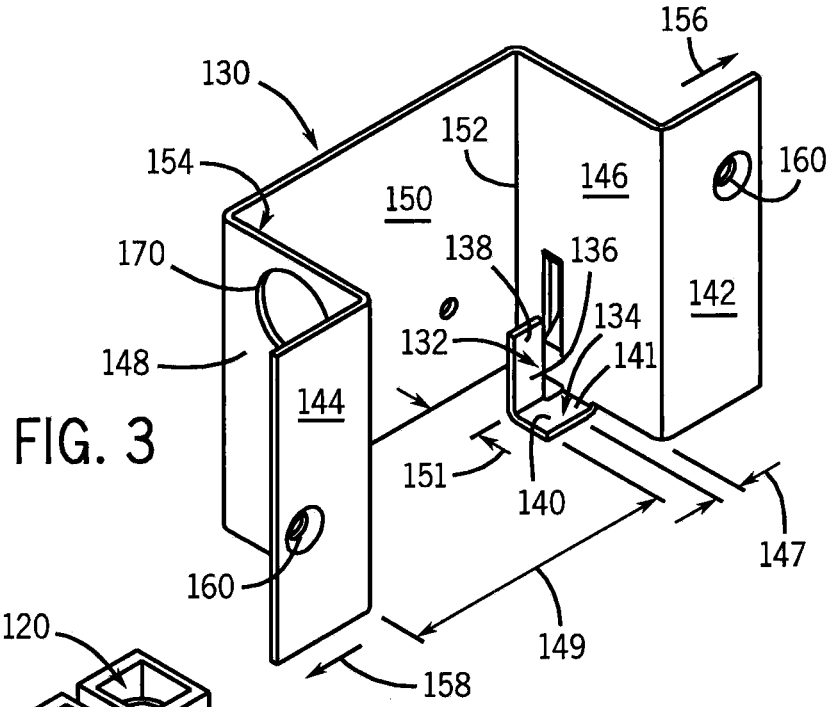
FIG. 3 is top, front, perspective view of one embodiment of a mounting bracket including a grounding tab and supporting member according to the invention.

FIGS. 3-7 illustrate a first embodiment of a grounding system 110 and a method of grounding a component of electrical equipment (not shown) in an enclosure 116. A mounting bracket 130 can be part of the grounding system 110. The mounting bracket 130 can include a grounding tab 132 and a support member 134. The grounding tab 132 and the support member 134 can be coupled to the mounting bracket 130. The grounding tab 132 can include a proximal portion 136 and a distal portion 138, the proximal portion 136 being coupled to the support member 134 on a distal end 140 of the support member 134. As shown in FIG. 3, the grounding tab 132 can be substantially perpendicular to the support member 134 and can be rigidly coupled to the support member 134.

Figure 4:
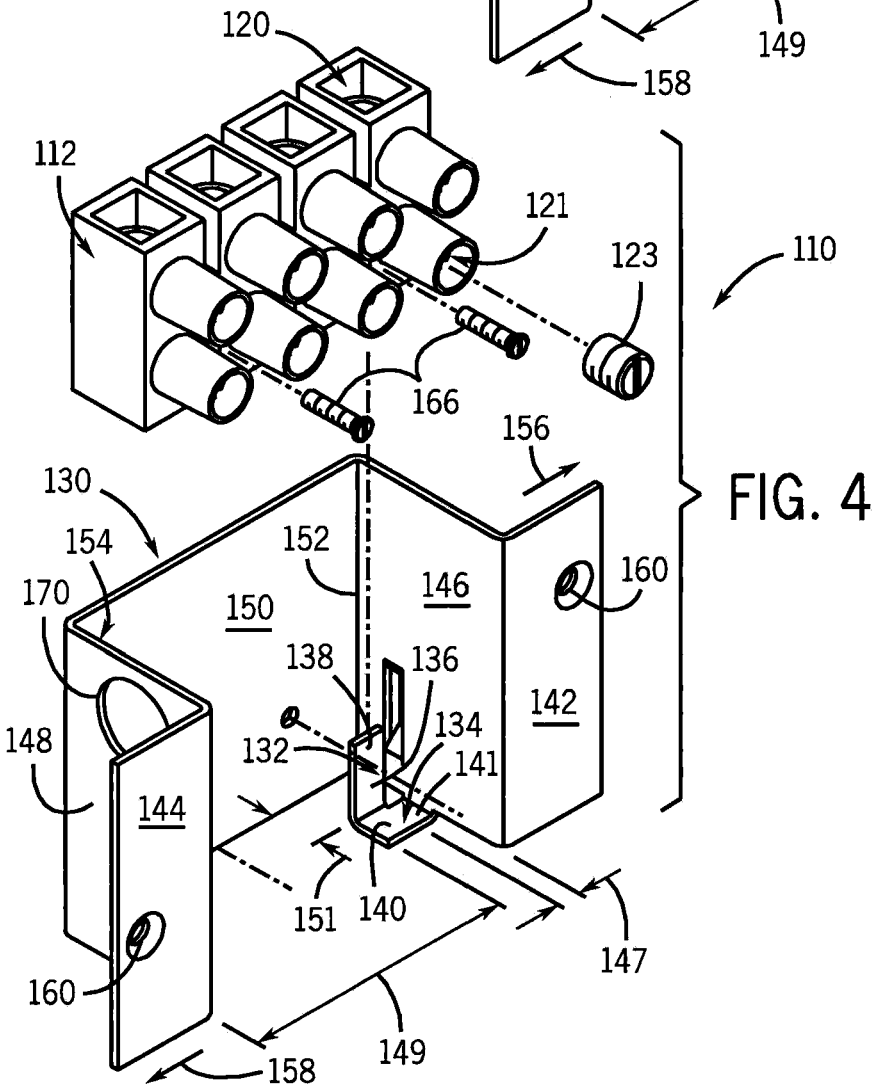
FIG. 4 is an exploded, top, front, perspective view of the mounting bracket of FIG. 3 and a terminal block and associated fasteners.
Figure 5:
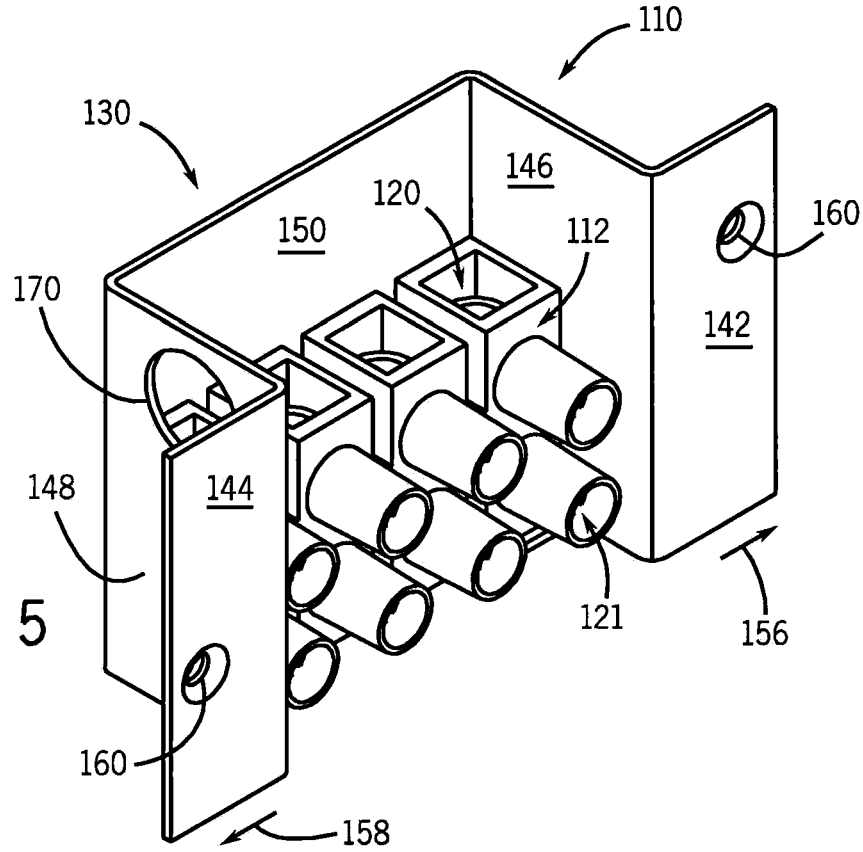
FIG. 5 is a top, front, perspective view of the mounting bracket of FIG. 4 assembled with the terminal block of FIG. 4.

As illustrated in FIGS. 3-5, the mounting bracket 130 can also include a first mounting flange 142, a second mounting flange 144, a first side panel 146, a second side panel 148, and a back panel 150. The first side panel 146 is coupled to the back panel 150 on a first end 152 of the back panel 150 and the second side panel 148 is coupled to the back panel 150 on a second end 154 of the back panel 150, opposite from the first end 152. The first mounting flange 142 can extend from the first side panel 146 in a first direction 156 and the second mounting flange 144 can extend from the second side panel 148 in a second direction 158, opposite from the first direction 156. The first side panel 146 and second side panel 148 can be substantially perpendicular to the first mounting flange 142, the second mounting flange 144, and/or the back panel 150. The back panel 150 can be recessed from the first mounting flange 142 and the second mounting flange 144.

The grounding tab 132 can be coupled to the first side panel 146 of the mounting bracket 130 by being coupled to a distal end 140 of the support member 134, with the proximal end 141 of the support member 134 being coupled to the first side panel 146. Alternatively, the grounding tab 132 can be coupled to the back panel 150 of the mounting bracket 130 by being coupled to a distal end 140 of the support member 134, with the proximal end 141 of the support member 134 being coupled to the back panel 150, or the grounding tab 132 can be coupled to the second side panel 148 by being coupled to a distal end 140 of the support member 134, the proximal end 141 of the support member 134 being coupled to the second side panel 148. It is contemplated that the grounding tab 132, support member 134, and mounting bracket 130 can be one integral component, such as shown in FIGS. 3 and 4, or could each be separate components connected together or some combination of integral and separate components.

Figure 7:
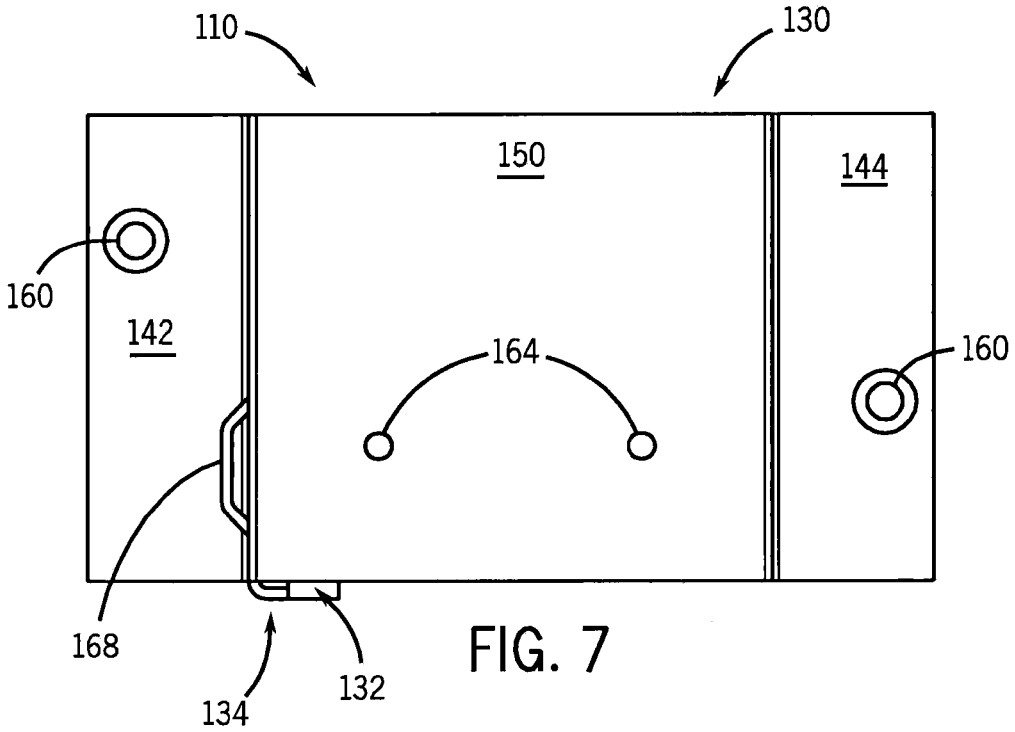
FIG. 7 is a rear, elevational view of the assembled mounting bracket and terminal block of FIG. 5.

The first mounting flange 142 and the second mounting flange 144 can each include apertures 160 for receiving fasteners 162 to couple the mounting bracket 130 to an enclosure 116, as discussed further below and depicted in FIG. 9. Additionally, the back panel 150 can include apertures 164 for receiving fasteners 166 to couple a terminal block 112 to the mounting bracket 130. The mounting bracket 130 can also include a wire-tie lance 168, as best shown in FIG. 7, for organizing wires 115 connected to the terminal block 112 (see FIG. 9). The wire-tie lance 168 can be coupled to the first side panel 146 of the mounting bracket 130. The second side panel 148 can also include a hole 170 for organizing wires 113 connected to the terminal block 112 (see FIG. 9).

As shown in FIGS. 4-9, the grounding system 110 can assemble a terminal block 112 with the mounting bracket 130 to ground the electrical equipment to the enclosure 116. The terminal block 112 depicted in FIGS. 4-9 can be a terminal block for connecting three-phase power to a component of electrical equipment in a conventional manner known to one of ordinary skill in the art using wires 113, 115 and a series of fasteners 172. The terminal block 112 also includes a grounding socket 120. Of course, it is contemplated that other types and sizes of terminal blocks can apply to the grounding systems described herein, which may vary based on the type of equipment to be grounded or other considerations. The grounding socket 120 of the terminal block 112 can include an opening 121 for receiving a fastener 123. Fastener 123, along with the series of fasteners 172 for connecting wires 113, 115 to the terminal block 112, can be a set screw. However, it is contemplated that other types of fasteners could be employed with the grounding system 110.

The mounting bracket 130 and other components of the grounding system 110 can be sized to ease the assembly of the terminal block 112 with the mounting bracket 130. As shown in FIG. 4, the grounding tab 132 can be offset from the first side panel 146 by an offset distance 147. Additionally, the grounding tab 132 can also be offset from the back panel 150 by an offset distance 151. Moreover, the grounding tab 132 can be offset from the second side panel 148 by an offset distance 149. In assembling the grounding system 110, the terminal block 112 can be moved into position such that the grounding socket 120 contacts the grounding tab 132.

For example, as shown in FIGS. 4 and 5, the terminal block 112 can be lowered such that at least a distal portion 138 of the grounding tab 132 is received in the grounding socket 120, or in other words, the terminal block 112 is lowered to guide the grounding socket 120 over the distal portion 138 of the grounding tab 132. In doing so, the offset distance 147 of the grounding tab 132 from the first side panel 146 provides that the first side panel 146 can at least partially support the terminal block 112 by frictionally engaging the terminal block 112, and as such, serve as a guide in moving the grounding socket 120 over the distal portion 138 of the grounding tab 132 when the distal portion 138 of the grounding tab 132 partially extends into the grounding socket 120. In the same fashion, the offset distance 151 of the grounding tab 132 from the back panel 150 and/or the offset distance 149 of the grounding tab 132 from the second side panel 148 provides that the back panel 150 and the second side panel 148, respectively, can at least partially support the terminal block 112 by frictionally engaging the terminal block 112, and as such, serve as a guide in moving the grounding socket 120 over the distal portion 138 of the grounding tab 132 when the distal portion 138 of the grounding tab 132 partially extends into the grounding socket 120. As a result, the mounting bracket 130 can provide for simplified and reliable assembly of the terminal block 112 with the grounding tab 132, even if the mounting bracket 130 and terminal block 112 are located in an area of an enclosure that is difficult to reach or is crowded with other equipment. The mounting bracket 130 and its components can be sized to provide these same advantages for different sizes and/or types of terminal blocks 112.

Figure 6:
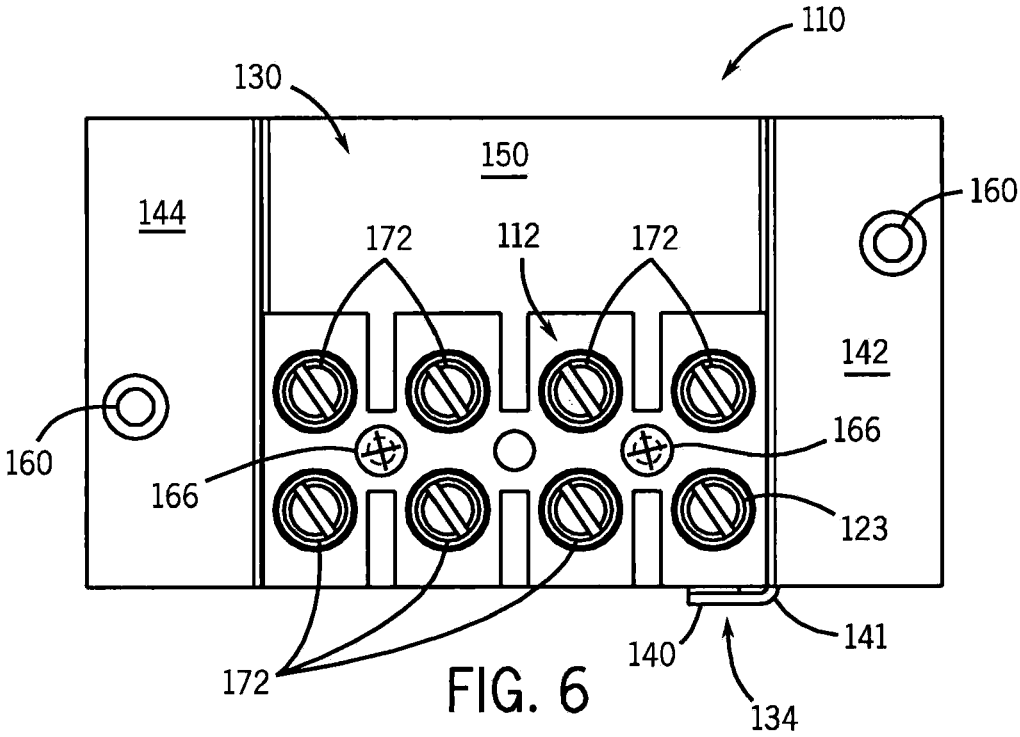
FIG. 6 is a front, elevational view of the assembled mounting bracket and terminal block of FIG. 5.

The support member 134 also provides for enhanced installation of the terminal block 112 to the mounting bracket 130. As shown in FIG. 5, the support member 134 can contact and support the terminal block 112 when at least a portion of the distal portion 138 of the grounding tab 132 is received in the grounding socket 120. Accordingly, once the grounding socket 120 of the terminal block 112 is guided into assembly with the grounding tab 132 as described above, a user installing the grounding system 110 can release their grip on the terminal block 112 because the terminal block 112 is supported by the support member 134 and the mounting bracket 130. With the terminal block 112 being supported, the user advantageously has both hands free to couple the terminal block 112 to the mounting bracket 130 with fasteners 166, as illustrated in FIGS. 4 and 6.

Figure 8:
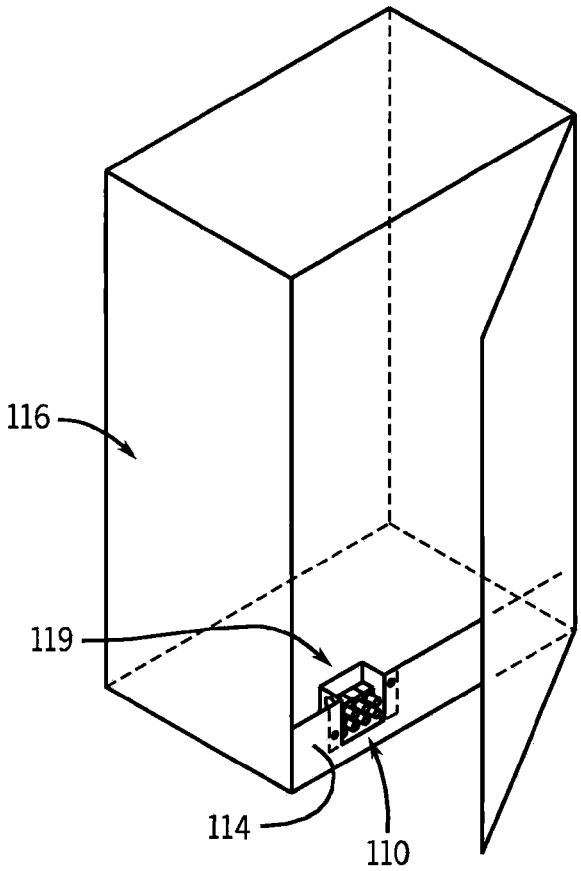
FIG. 8 is a top, front, perspective view of a grounding system and terminal block of FIG. 5 installed in a front portion of an enclosure.
Figure 9:
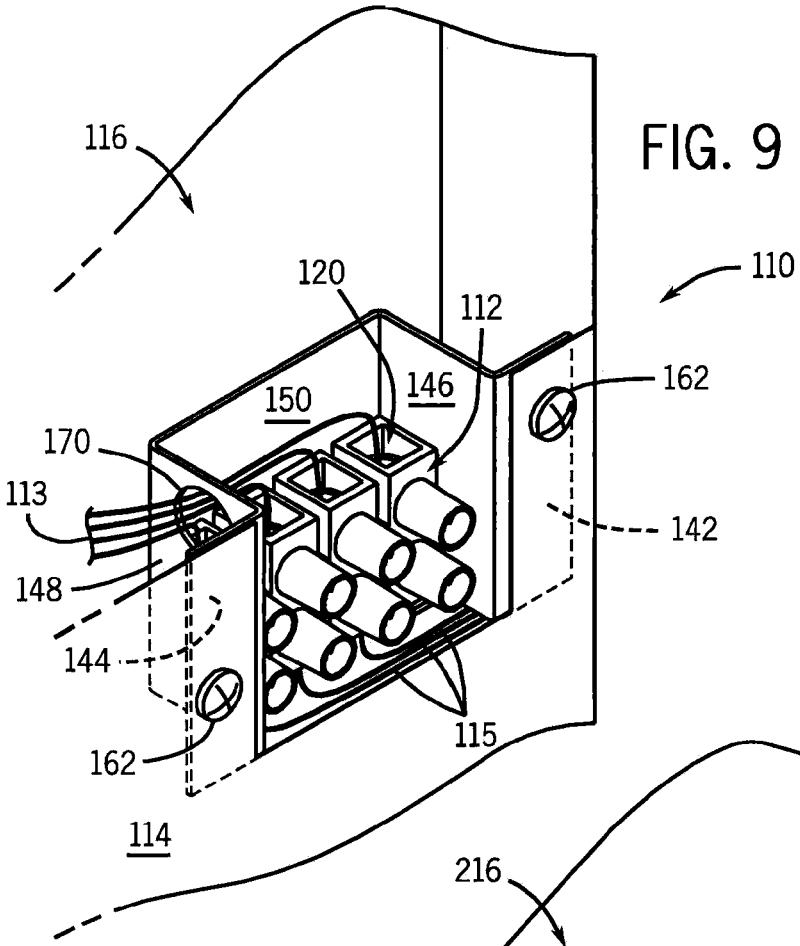
FIG. 9 is a detailed, perspective view of the grounding system of FIG. 8 grounding the electrical equipment wired to the terminal block to the chassis of the enclosure.

FIGS. 8 and 9 illustrate a first embodiment of a grounding system 110 where the mounting bracket 130 can be coupled to the chassis 114 of the enclosure 116 with fasteners 162 at the mounting flanges 142, 144. Advantageously, the grounding system 110 can be coupled to the chassis 114 near a front portion 119 of the enclosure 116 such that it is easier to access for installation and/or maintenance. To ground the component of electrical equipment (not shown) to the chassis 114 of the enclosure 116, the fastener 123 can be tightened in the opening 121 on the grounding socket 120 such that the fastener 123 passes through the opening 121 in the grounding socket 120 and contacts the grounding tab 132, as discussed above with respect to FIGS. 4-6. The contact between the fastener 123 and the grounding tab 132 grounds the electrical equipment wired to the terminal block 112 due to the coupling of the grounding tab 132 to the mounting bracket 130, which in turn is coupled to the chassis 114 of the enclosure 116. As discussed above, the terminal block 112 is wired to the component of electrical equipment, as is known by those of ordinary skill in the art, with wires 113, 115 and fasteners 172 (see FIGS. 6 and 9). Therefore, the grounding system 110 grounds the component of electrical equipment wired to the terminal block 112 without the additional components of a grounding wire 18, wire clip 22, and fastener 24 as is common in prior art grounding systems 10. Accordingly, the grounding system 110 provides cost savings for grounding a piece of electrical equipment in an enclosure 116 that can be wired to a terminal block 112. Additionally, the grounding system 110 provides for more efficient and hands-free installation of the terminal block 112 in the enclosure 116.

Figure 10:
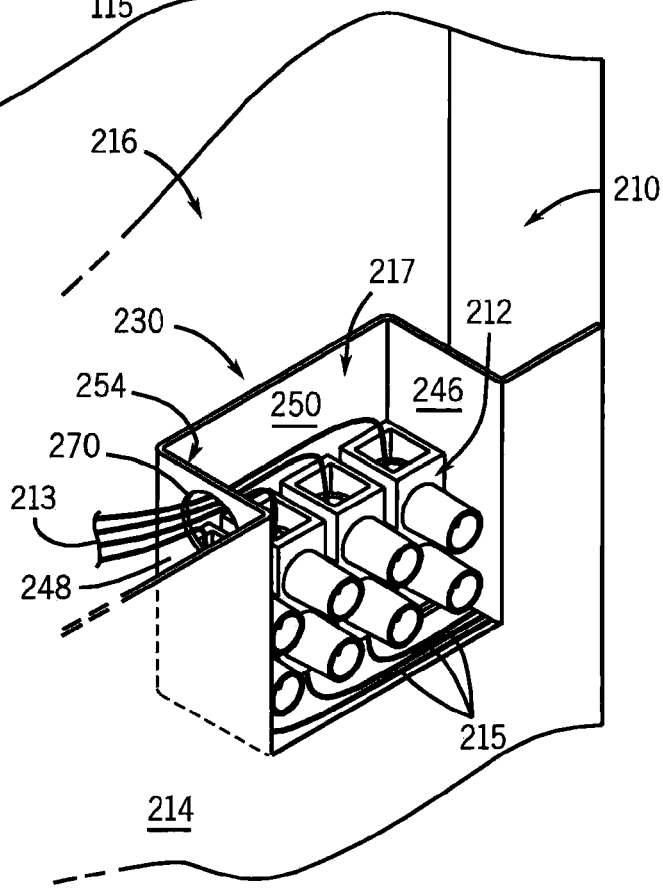
FIG. 10 is a detailed, perspective view of a second embodiment of a grounding system grounding the electrical equipment wired to the terminal block to the chassis of the enclosure where there is a receiving portion that is integral to the chassis of the enclosure.

FIG. 10 illustrates an alternative embodiment of a grounding system 210 in which the mounting bracket 230 forms an integral portion of the chassis 214 of the enclosure 216 in that the enclosure 216 includes a receiving portion 217 integral to the chassis 214 for receiving a terminal block 212. The receiving portion 217 can be integrated with the chassis 214 and can include a first side panel 246 coupled to a first end 252 of a back panel 250 and a second side panel 248 coupled to a second end 254 of the back panel 250 opposite the first end 252. The grounding system 210 can contain the same components as grounding system 110 described above, can be assembled with a terminal block 212 in a similar manner, and can provide the same advantages as described above with respect to grounding system 110.

The mounting bracket 130, 230, grounding tab 132, 232 and support member 134, 234 are preferably composed of sheet metal. However, the mounting bracket 130, 230, grounding tab 132, 232 and support member 134, 234 can be composed of other conductive materials that can ground the component of electrical equipment. Portions of the mounting bracket 130, 230, including, but not limited to, the back panel 150, 250 and the second side panel 148, 248 can be composed of non-conductive materials if desired. In the circumstance where the mounting bracket 230 forms an integral portion of the chassis 214 of the enclosure 216, it is preferred that the mounting bracket 230 and associated components are uniformly composed of the same material as the chassis 214 itself.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto.

The invention claimed is:

1. A grounding system for a terminal block for wiring to electrical equipment housed within an enclosure having a chassis, the terminal block having a grounding socket with an opening for receiving a fastener, the grounding system comprising:

a mounting bracket configured to be coupled to the chassis of the enclosure; and a grounding tab coupled to the mounting bracket, the grounding tab including a proximal portion and a distal portion, the distal portion configured to at least partially extend into the grounding socket of the terminal block so that the fastener passes through the opening in the grounding socket, contacts the grounding tab, and grounds the electrical equipment wired to the terminal block.

2. The grounding system of claim 1, and further comprising a support member supporting the terminal block when the distal portion of the grounding tab at least partially extends into the grounding socket of the terminal block, a proximal end of the support member being coupled to the mounting bracket and a distal end of the support member being coupled to the proximal end of the grounding tab.

3. The grounding system of claim 2, wherein the grounding tab is substantially perpendicular to the support member and is rigidly coupled to the support member.

4. The grounding system of claim 1, wherein the mounting bracket includes a first mounting flange, a first side panel, and a back panel, the back panel being recessed from the first mounting flange and adapted to be coupled to the terminal block.

5. The grounding system of claim 4, wherein the grounding tab is coupled to the first side panel.

6. The grounding system of claim 5, wherein the grounding tab is offset from the first side panel with a first offset distance, the first offset distance providing that the first side panel at least partially supports the terminal block when the distal portion of the grounding tab at least partially extends into the grounding socket of the terminal block.

7. The grounding system of claim 4, wherein the grounding tab is offset from the back panel with a second offset distance, the second offset distance providing that the back panel at least partially supports the terminal block when the distal portion of the grounding tab at least partially extends into the grounding socket of the terminal block.

8. The grounding system of claim 4, wherein the mounting bracket further includes a second mounting flange and a second side panel, the first side panel coupled to the back panel on a first end of the back panel, the second side panel coupled to the back panel on a second end of the back panel, the first end being opposite from the second end, the first mounting flange extending from the first side panel in a first direction, the second mounting flange extending from the second side panel in a second direction, the first direction being opposite from the second direction.

9. The grounding system of claim 8, wherein the first side panel of the mounting bracket, the back panel of the mounting bracket, and the second side panel of the mounting bracket each at least partially support the terminal block when the distal portion of the grounding tab at least partially extends into the grounding socket of the terminal block.

10. The grounding system of claim 1, wherein the mounting bracket is configured to be coupled to the chassis with at least one fastener.

11. The grounding system of claim 1, wherein the mounting bracket is coupled to the chassis by forming an integral portion of the chassis.

12. The grounding system of claim 1, wherein the mounting bracket is coupled to the chassis near a front of the enclosure.

13. An enclosure grounding system for grounding an electrical component, the electrical component wired to a terminal block, the terminal block having a grounding socket with an opening for receiving a fastener, the enclosure grounding system comprising:

an enclosure configured to house the electrical component, the enclosure including a chassis; and a grounding system including a mounting bracket and a grounding tab, the mounting bracket coupled to the chassis of the enclosure, a grounding tab coupled to the mounting bracket, the grounding tab including a proximal portion and a distal portion, the distal portion configured to at least partially extend into the grounding socket of the terminal block such that a fastener passes through the opening in the grounding socket, contacts the grounding tab, and grounds the electrical component wired to the terminal block.

14. The enclosure grounding system of claim 13, and further comprising a support member supporting the terminal block when the distal portion of the grounding tab at least partially extends into the grounding socket of the terminal block, a proximal end of the support member being coupled to the mounting bracket and a distal end of the support member being coupled to the proximal end of the grounding tab.

15. The enclosure grounding system of claim 13, wherein the mounting bracket includes a first mounting flange, a first side panel, and a back panel, the back panel being recessed from the first mounting flange and adapted to be coupled to the terminal block.

16. The enclosure grounding system of claim 15, wherein the grounding tab is coupled to the first side panel.

17. The enclosure grounding system of claim 16, wherein the grounding tab is offset from the first side panel with a first offset distance, the first offset distance providing that the first side panel at least partially supports the terminal block when the distal portion of the grounding tab at least partially extends into the grounding socket of the terminal block.

18. The enclosure grounding system of claim 15, wherein the grounding tab is offset from the back panel with a second offset distance, the second offset distance providing that the back panel at least partially supports the terminal block when the distal portion of the grounding tab at least partially extends into the grounding socket of the terminal block.

19. The enclosure grounding system of claim 16, wherein the mounting bracket further includes a second mounting flange and a second side panel, the first side panel coupled to the back panel on a first end of the back panel, the second side panel coupled to the back panel on a second end of the back panel, the first end being opposite from the second end, the first mounting flange extending from the first side panel in a first direction, the second mounting flange extending from the second side panel in a second direction, the first direction being opposite from the second direction, and wherein the first side panel of the mounting bracket, the back panel of the mounting bracket, and the second side panel of the mounting bracket are each adapted to guide the grounding socket of the terminal block over the distal portion of the grounding tab.

20. The enclosure grounding system of claim 13, wherein the mounting bracket is coupled to the chassis by forming an integral portion of the chassis.

21. The enclosure grounding system of claim 13, wherein the mounting bracket is coupled to the chassis near a front of the enclosure.

22. A grounding system for a terminal block for wiring to electrical equipment housed within an enclosure having a chassis, the terminal block having a grounding socket with an opening for receiving a fastener, the grounding system comprising:

a mounting bracket configured to be coupled to the chassis of the enclosure, the mounting bracket including a first mounting flange, a first side panel, and a back panel;

a support member having a proximal end and a distal end, the proximal end coupled to the first side panel; and a grounding tab including a proximal portion and a distal portion, the proximal portion coupled to the distal end of the support member;

the distal portion of the grounding tab configured to at least partially extend into the grounding socket of the terminal block so that the fastener passes through the opening in the grounding socket, contacts the grounding tab, and grounds the electrical equipment wired to the terminal block, and the support member supports the terminal block when the distal portion of the grounding tab at least partially extends into the grounding socket.

23. An enclosure grounding system for grounding an electrical component, the electrical component wired to a terminal block, the terminal block having a grounding socket with an opening for receiving a fastener, the enclosure grounding system comprising:

an enclosure configured to house the electrical component, the enclosure including a chassis and a receiving portion for receiving the terminal block, the receiving portion being integral to the enclosure; and a grounding system including a support member and a grounding tab, the support member having a proximal end and a distal end, the proximal end coupled to the enclosure, the grounding tab including a proximal portion and a distal portion, the proximal portion coupled to the distal end of the support member, the distal portion of the grounding tab configured to at least partially extend into the grounding socket of the terminal block so that the fastener passes through the opening in the grounding socket, contacts the grounding tab, and grounds the electrical equipment wired to the terminal block, and the support member supporting the terminal block when the distal portion of the grounding tab at least partially extends into the grounding socket.

24. The enclosure grounding system of claim 23, wherein the receiving portion is integral to the chassis.

25. The enclosure grounding system of claim 23, wherein the receiving portion includes a first side panel, a second side panel, and a back panel, the first side panel coupled to the back panel near a first end of the back panel, the second side panel coupled to the back panel near a second end of the back panel, the second end of the back panel being opposite from the first end of the back panel.

* * * * *